US006624794B1

(12) United States Patent
Wendt et al.

(10) Patent No.: US 6,624,794 B1
(45) Date of Patent: Sep. 23, 2003

(54) ANTENNA WITH AT LEAST ONE VERTICAL RADIATOR

(75) Inventors: Dirk Wendt, Dettingen (DE); Martin Kuhn, Stugart (DE); Markus Pfletschinger, Eningen (DE); Peter Riedhofer, Metzingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 09/979,168

(22) PCT Filed: May 17, 2000

(86) PCT No.: PCT/EP00/04449

§ 371 (c)(1),
(2), (4) Date: Jan. 17, 2002

(87) PCT Pub. No.: WO00/70711

PCT Pub. Date: Nov. 23, 2000

(30) Foreign Application Priority Data

May 18, 1999 (DE) ..... 199 22 699

(51) Int. Cl.[7] ..... H01Q 1/50
(52) U.S. Cl. ..... 343/864; 343/713
(58) Field of Search ..... 343/700 MS, 702, 343/895, 846, 713, 864

(56) References Cited

U.S. PATENT DOCUMENTS

| | | | | |
|---|---|---|---|---|
| 5,146,232 A | | 9/1992 | Nishikawa et al. | 343/713 |
| 5,532,707 A | | 7/1996 | Klinger et al. | 343/793 |
| 5,818,394 A | | 10/1998 | Aminzadeh et al. | 343/713 |
| 5,929,812 A | | 7/1999 | Aminzadeh | 343/700 MS |
| 2001/0030627 A1 | * | 10/2001 | Andersson | 343/702 |

FOREIGN PATENT DOCUMENTS

| | | | |
|---|---|---|---|
| DE | 43 02 905 C1 | 3/1994 | H01Q/1/36 |
| DE | 195 04 577 A1 | 8/1996 | H01Q/13/10 |
| DE | 196 14 068 A1 | 10/1997 | H01Q/13/10 |
| DE | 196 46 100 A1 | 5/1998 | H01Q/13/10 |
| EP | 0 444 679 A2 | 9/1991 | H01Q/9/40 |

* cited by examiner

*Primary Examiner*—Hoang Nguyen
(74) *Attorney, Agent, or Firm*—Fulbright & Jaworski, LLP

(57) ABSTRACT

In an antenna having at least one vertical radiator, preferably a vehicle mobile radiotelephone antenna, the at least one vertical radiator is connected to the ground on one end and to a vertical conductor fed against the ground on the other end by means of an impedance transforming device having an electrical length which is approximately one fourth the mean operating wavelength or an uneven multiple thereof. Said structure makes it possible for the at least one vertical radiator to have a uniform current occupancy over its entire length. By cooperating with the vertical conductor fed in a co-radiating manner, said occupancy exhibits high radiation power comparable to that of a $\lambda/4$ monopole antenna despite the fact that the at least one vertical radiator has a smaller length which is approximately 1/10 of the mean operating wavelength. The invention also describes advantageous embodiments or configurations of said antenna and practical arrangements of said antenna in vehicles.

37 Claims, 2 Drawing Sheets

ANTENNA WITH AT LEAST ONE VERTICAL RADIATOR

BACKGROUND OF THE INVENTION

1. Field of the Invention

The invention relates to an antenna device. More particularly, the present invention relates to an antenna device having at least one vertical radiator.

2. Description of the Related Technology

Antennas which are intended for sending and receiving high frequency signals, especially in mobile radio telephone ranges (0.8–1.9 GHz), are known from practice in various versions as rod antennas or integrated antennas. Rod radiators in a straight or kinked version for mobile radio telephone service are used especially as λ/4-long or short thick monopoles ("stub antennas") which are made alternatively for installation in a hole on a body part, for example the motor vehicle roof, for cementing to the vehicles windows as so-called "on-glass" antennas, or as integrated antennas (for example as described in German patent application 198 41 187.1.

Quarter wave monopoles with respect to their radiation power are optimum at the lower frequencies of the mobile radio telephone ranges, but due to their vertical length of up to roughly 8 cm are not suited for installation in flat spaces, for example, between a motor vehicle roof and its inner lining, the so-called head liner.

Shortened monopole antennas with a length of roughly λ/10 or less, which are possible mechanically for flat space installation sites, however, do not have the desired or the required radiation power. This also applies to bent monopoles with a total length which can be λ/4, but with a vertically polarized portion of the radiation power which is too small for many applications due to the length of the vertical radiator part.

SUMMARY OF THE INVENTION

An object of the invention is therefore to devise an antenna of the initially mentioned type in which the vertical radiators have a radiation power comparable to a λ/4 monopole, but with a length in the vertical direction which is as small as possible and thus is suitable for installation at installation sites with a low height.

This and other objects may be achieved by providing an antenna with at least one vertical radiator, wherein one end of said at least one vertical radiator is connected to a ground and the other end is connected, via an impedance transformation means (which has an electrical length of about one-fourth of the average operating wavelength or an odd multiple thereof) to a vertical conductor which is supplied against said ground.

As a result of the arrangement of at least one vertical radiator at an electrical distance of λ/4 from the supplied vertical conductor of the antenna in conjunction with matching by impedance transformation means, a large current flows through each vertical radiator at a current filling capacity which is roughly constant over its entire length and thus causes a high radiation power in the vertical polarization direction. Moreover, the supplied vertical conductor between the terminal site of the feed source and the impedance transformation means delivers a vertically polarized radiation portion so that the antenna overall at a length of at least one vertical radiator of less than λ/10 at the lowest mobile radio telephone frequency has a radiation power comparable to the λ/4 monopole. This minimized construction of the antenna in the vertical direction of a maximum height of roughly 2.2 cm enables its installation in shallow cavities or flat spaces, for example between the roof and the inside lining of motor vehicles.

The impedance transformation means in an electrical circuit can consist of discrete circuit elements or can be made as a high frequency line with the corresponding wave impedance which is especially feasible when it is to operate permanently without interference regardless of climatic conditions and vibration movements, as in motor vehicles.

The vertical radiator or radiators can consist of wire, but with respect to mechanical stability and low ohmic losses, it is more favorable to make it or them either as thick, for example cylindrical metal parts, or to produce them from sheet metal strips.

Advantageous embodiments and developments of the antenna as claimed in the invention are given in the dependent claims.

According to one aspect of the invention, the antenna may comprise two vertical radiators disposed equidistant from the supplied vertical conductor.

Thus, the arrangement is indeed longer and more complex, but has better matching to a 50 ohm feed source and a symmetrical radiation pattern which is desired or even necessary in many cases.

According to another aspect of the invention, the unit consisting of the vertical radiators, the supplied vertical conductor, and the impedance transformation means is made as an integral punched beat part from metal.

This construction results in an especially simple and economically producible antenna structure which moreover is mechanically stable and has low ohmic losses, wherein its vertical radiator can be easily connected to ground for example by soldering or spot welding. In addition, it is possible without added costs to make the individual sheet metal parts in a certain shape.

According to another aspect of the invention, the antenna may include a metallic reflector, whereby a directional effect which is desired in many applications can be produced and can be adapted within limits to the requirements of the individual case by the arrangement and shape of the reflector.

In accordance with one feature of the invention, the reflector is located between the vehicle interior and the unit consisting of the vertical radiator, impedance transformation means and supplied vertical conductor, whereby the radiation which can penetrate into the motor vehicle interior is greatly reduced. As will be appreciated by one of ordinary skill in the art; this at least in the case of transmission represents an important protection for the passengers and moreover protects against equipment interference.

According to another feature of the invention, one especially simple structure is realized by having the reflector serve as the ground surface.

Since motor vehicle antennas are always located in the vicinity of the body, it may be advantageous to use it as a grounding surface wherein the reflector is electrically connected to the metallic motor vehicle body. According to the invention, it can be connected either conductively or capacitively to the reflector. The latter alternative may be preferable since the enameling of the body which took place before antenna installation need not be removed at the terminal site for conductive contact-making.

The arrangement of the antenna between the covered openings of motor vehicles transparent to electromagnetic radiation may be preferable because it doesn't interfere with its operation but protects the antenna from environmental effects, manipulations and damage. Due to the cover, the antenna is not visible from the outside and thus gives no unwanted indication that the motor vehicle is equipped with a mobile phone. Preferred installation sites include the metallic edge areas of motor vehicle windows, plastic roofs of motor vehicles, or other plastic areas (for example sliding roofs) of metallic motor vehicle roofs.

For screening of motor vehicle windows, for example, conventionally black printing of the affected area is not only especially simple and economical, but moreover protects against glare.

According to the invention, advantageous positioning of the antenna between the motor vehicle opening and interior lining molded parts, wherein the reflector is shaped to match the interior lining molded part, projection into the vehicle interior may be avoided with minimum cost. In addition, arrangement between the body and inside lining ensures adequate holding of the antenna even without special fasteners.

According to one aspect of the invention, one especially suitable installation site for motor vehicle mobile radio telephone antennas is in the vicinity of the roof edge of the front or rear window. According to this aspect, a partial area of the reflector advantageously adjoins the roof flange directly or via an intermediate part. The intermediate part can be metallic or, to influence the coupling factor of the capacitive coupling between the reflector and metal body, it can consist of plastic with an appropriate dielectric constant. Moreover, this intermediate part can if necessary by made and used as a retaining part.

One special advantage of this installation site is that antenna emission takes place not only according to the directional action dictated by the reflector, but additionally by wave guidance via the motor vehicle roof also in roughly the opposite direction. This radiation pattern greatly improves the efficiency of transmission and reception.

According to another aspect of the invention, the antenna is easily mechanically stable without the antenna components as such having to be stable. According to this aspect, the carrier part can be adapted to the requirements of the individual case by the corresponding choice of material. For example, a carrier of styropor is light and economical. When using a material with a high dielectric constant the antenna can be made even smaller.

It is especially simple and economical to make the antenna components as metal coatings of the carrier part and/or to seal or extrusion- coat them in the carrier parts, the injection molding mass forming the carrier part.

Of course combinations of these versions are possible. One advantageous embodiment consists for example in extrusion coating with plastic the vertical radiators, the impedance transformation means, the vertical feed conductor and the cable set and providing the reflector as a metal coating, for example, a metal foil which is cemented on the carrier part which is made as an injection molding.

If fasteners are required in the individual case, they can be economically prepared as a part of the carrier part itself or as parts sealed therein.

One advantageously simple and generally space-saving arrangement of the carrier part and thus of the complete antenna is to attach the carrier part directly to a motor vehicle part. In general, complex fastening means can thus be avoided. This applies especially to fastening by cementing, for example, to the motor vehicle rear window. A carrier part configured to correspond to the vehicle parts which surround it can dispense entirely with any fastening material when the parts surrounding it, for example, the motor vehicle roof and the inside roof lining, are profiled such that the antenna which has been placed in between is fixed after installation of the parts which enclose it.

Aside from the cases in which a reinforcing element is connected directly to the supplied vertical conductor (active antenna), connection to the relevant transmitter output and receiver input circuits takes place via a feed line. According to the invention, there are various possibilities for its connection. As will be appreciated by one of ordinary skill in the art, the space of the installation site available in the vertical direction allows, the feed line can be supplied though a recess of the ground surface or the reflector to the supplied vertical conductor. In this case there is no interference of the electromagnetic field at all between the radiator parts and the reflector by the feed line.

As will also be appreciated, if on the other hand, minimum dimensions of the antenna including the feed line are important, the electrical connection of the supplied vertical conductor preferably takes place via the closed ground surface and the feed line is supplied laterally. With this alternative, the interfering effect of the feed line on the field between the radiator parts and the reflector is minimized by its routing on the ground surface or the reflector.

Preferably, the feed line is a coaxial cable which is connected to the vertical feed conductor. For example, the coaxial cable may have an inner conductor which is conductively connected to the supplied vertical conductor and an outer conductor which is conductively connected to the ground surface.

Broadband matching of the antenna connection to the feed line can be economically achieved by the vertical feed conductor widening increasingly from the cable terminal to the transition to the impedance transformation means. In the case in which the radiator elements are made as a punched bent part, the vertical feed conductor is easily made as a triangular bent part with a tip which makes contact with the inner conductor of the coaxial feed cable.

It is preferable for the broadband matching for wave passage from the cable to the feed conductor to be made even more interference-free by the vertical feed conductor in the area of the cable terminal being encompassed roughly to a quarter of its length by a conically flaring ground surface.

A presently preferred embodiment of the feed line utilizes a doubly laminated board with one surface coated completely with a metal coating which represents the reflector and the other surfaces having a strip line-coplanar line which forms the fee line. This embodiment of the feed line is extremely simple and economical in production and installation and moreover has the advantage that it can be routed out laterally on the bottom of the ground surface without increasing the vertical antenna dimensions and thus cannot cause field interference in the antenna near field.

According to one embodiment, the impedance transformation line(s) consisting of a metal strip, wire or a metal coating applied to the dielectric carrier is provided in a meandering configuration which enables shortening of the mechanical antenna length and thus is suited especially for the case in which the available installation space for the antenna is small in this direction as well.

According to the invention, the impedance transformation means may be configured as metal strips or have inserted tuning elements to improve the broadband transformation. In the case of making this means as wires or strip conductors, these elements can be made very easily and economically by reinforcements of the wires or two-dimensional enlargements (thickened areas) of a certain section of the strip conductors, especially in the vicinity of the connection site between the impedance transformation means and the vertical feed conductor.

One presently preferred embodiment for influencing the pattern shape and matching it to the requirements of the individual case for a dual vertical radiator embodiment of the invention connects the two vertical radiators, not in a straight line via the impedance transformation means, but to arrange them at an angle<180° to one another, with the connecting site of the impedance transformation means to one another and with the vertical feed conductor forming the vertex.

Another presently preferred embodiment of the invention configures the antenna elements (vertical radiator(s), vertical conductor, impedance transformation means, reflector) and carrier part are configured to match the shape of the installation site. With this configuration, special fasteners are generally unnecessary because the antenna elements are located securely within the parts housing them, for example, motor vehicle parts. Nowhere do they project in an unwanted manner from the installation site (for example, into the motor vehicle interior) and for their part can be used as a support, for example, for the interior lining of motor vehicles.

A presently preferred embodiment arranges the antenna in a motor vehicle asymmetrically to the lengthwise axis of the motor vehicle, for example, in the vicinity of the top right comer of the rear window, results in an improvement in the radiation pattern to the side.

When using the antenna in motor vehicles with a plastic body, it is especially advantageous to integrate the antenna into it, especially to economically install it during body production in one production step.

The described antennas can be combined with one another and/or with other antennas into an advantageous antenna system in order for example to improve the radiation pattern on both sides of the motor vehicle, to increase the antenna gain, and also to form a diversity means.

BRIEF DESCRIPTION OF THE DRAWINGS

The invention is explained below in the figures using an embodiment which is used as a mobile radio telephone antenna for motor vehicles.

DETAILED DESCRIPTION

Figure 1:
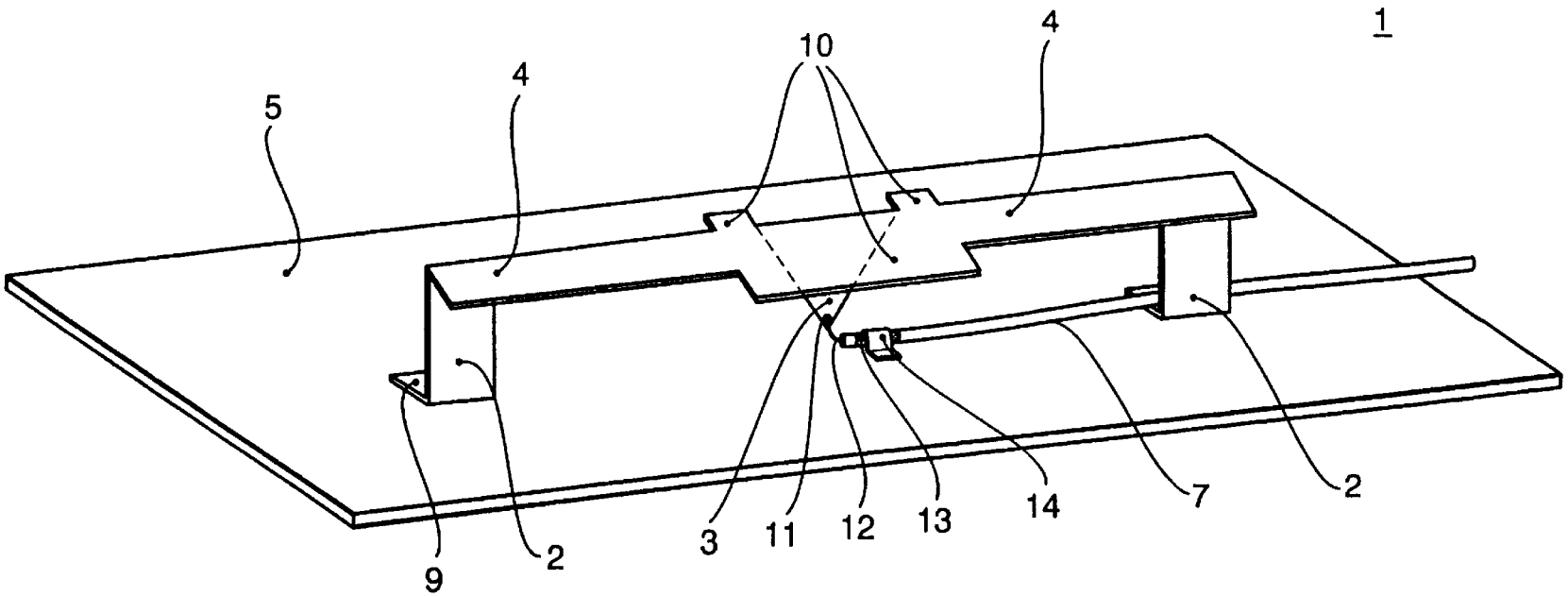
FIG. 1 shows a block diagram of the mobile radio telephone antenna without the carrier part.

The mobile radio telephone antenna 1 consists of two vertical radiators 2 with a length of roughly 1/10 of the average operating wavelength, two impedance transformation lines 4 which join them to one another and to the vertical feed conductor 3 which is located in the middle, a reflector 6 which is electrically connected to the ground surface 5, a coaxial cable set 7 and a dielectric carrier part 8.

The vertical radiators 2, the vertical feed conductor 3 and the impedance transformation lines 4 are economically produced in one piece as a punched bent part from sheet metal and are attached by means of bent brackets 9 of the vertical radiators 2 moreover to the ground surface 5 or the reflector 6 and are thus electrically connected thereto.

For broadband matching to the 50 ohm wave impedance of the coaxial cable 7, on the one hand the connecting area 10 of the impedance transformation lines 4 has an enlarged surface of a certain configuration with a size and shape which have been experimentally determined. On the other hand, the feed conductor 3 which is bent from the connecting area 10 towards the ground surface 5 is made triangular such that it tapers towards the terminal point 11 at which its tip is conductively connected to the cable inner conductor 12. The cable outer conductor 13 makes contact with the ground surface 5 or the reflector 6 by means of a clip 14. The coaxial connecting cable 7 is routed away laterally on the ground surface 5 or the reflector 6 and thus does not reduce the very small construction height of the antenna 1 of roughly 2.5 cm.

In the described structure, in spite of the short construction height, as a result of the current filling capacity which is roughly constant over the entire length of the vertical radiators 2 and the broadband matching a radiation power which is comparable to a $\lambda/4$ monopole is achieved.

Figure 2:
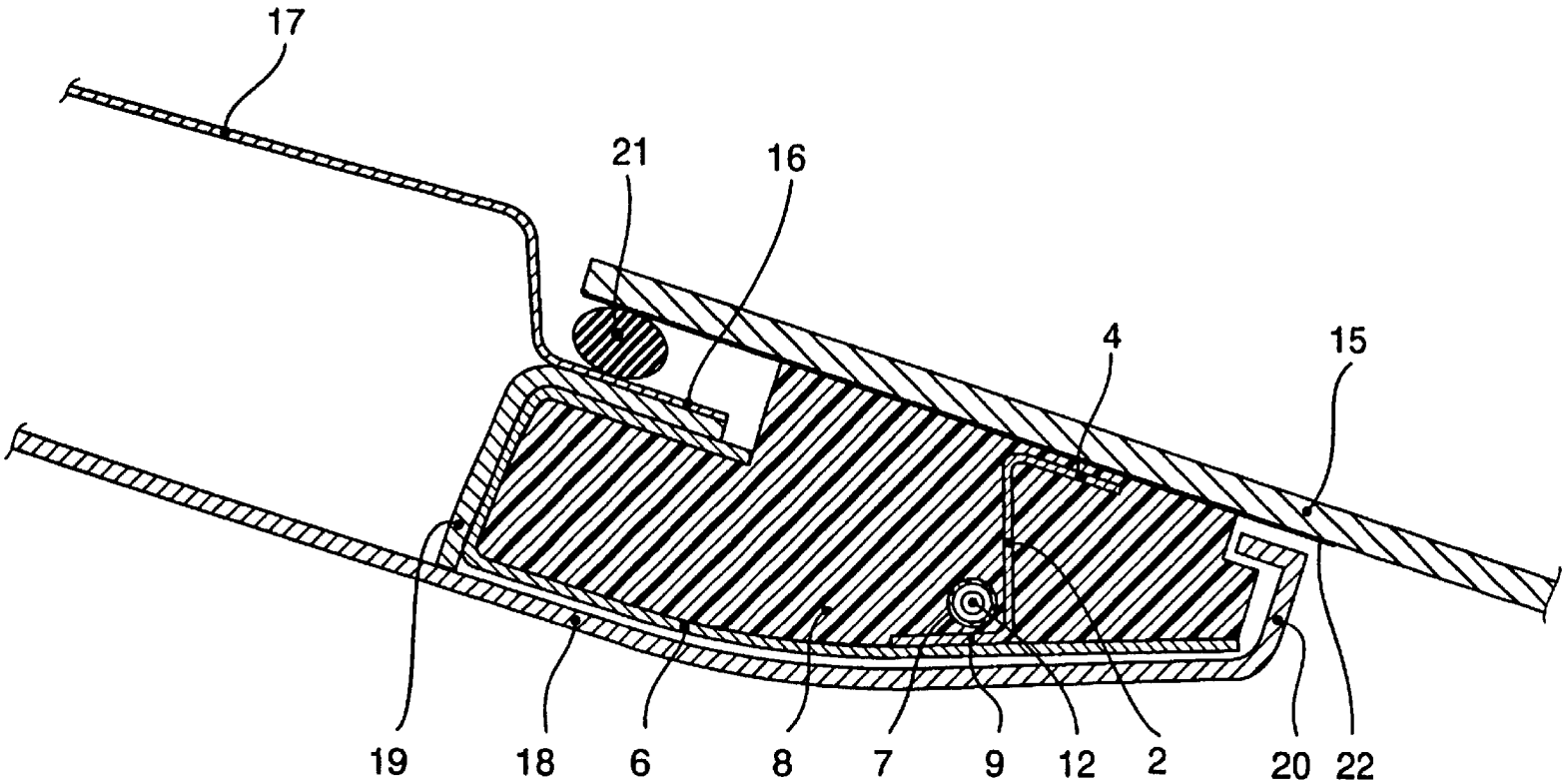
FIG. 2 shows a section through the mobile radio telephone antenna which is located in the top edge area of the motor vehicle window.

In the specific embodiment shown in FIG. 2 the antenna elements 2, 3 and 4 which are built as a unit are sealed into the plastic carrier part 8 together with the end area of the coaxial cable 7 which is connected to the feed conductor 3. On the surface which points toward the motor vehicle interior a metal coating which is used as the reflector 6 is applied to the carrier part 8, with which the clip 9 of the vertical radiators 2 and the cable outer conductor 13 are conductively connected.

The size of the antenna can be further reduced by the choice of a plastic with a relative dielectric constant>2.

The mobile radio telephone antenna 1 is located asymmetrically, i.e. in the top right corner area of the rear window 15, in the motor vehicle interior in the upper edge area of the rear window 15 between it, the flange 16 of the metallic motor vehicle roof 17 and the so-called head liner 18 which is attached to the inside lining of the motor vehicle roof 17.

To hold the mobile radio telephone antenna 1, the carrier part 8 is cemented securely in the inside surface of the rear window 15 and is encompassed by holding angles 19, 20 of the head liner 18 which is thus itself attached at this site.

The reflector 6 can be conductively connected to the flange 16 of the motor vehicle roof 17 which forms the ground surface, in this case it is separated from the roof flange 16 by the end section of the one holding angle 19 so that capacitive coupling is formed.

To seal the body opening between the rear window 15 and the motor vehicle roof 17, there is a bead 21 of cement.

The upper area of the rear window 15 is provided on the inside with black printing 22 such that the mobile radio telephone antenna 1 is not visible from the outside.

What is claimed is:

1. An antenna comprising:

a ground surface;

an impedance transformation device, said impedance transformation device having an electrical length of at least about one-quarter wavelength of an average operating wavelength of said antenna;

at least one radiator vertically disposed from said ground surface and connected to one end of said impedance transformation device; and a feed conductor vertically disposed from said ground surface and connected to the other end of said impedance transformation device, said feed conductor is disposed to conduct a current transmitted through said impedance transformation device in response to vertically polarized radiation power provided using said radiator and said feed conductor.

2. The antenna of claim 1, wherein said impedance transformation device has an electrical length which is an odd multiple of one-quarter wavelength of said average operating wavelength.

3. The antenna of claim 1, wherein said impedance transformation device comprises an impedance transformation line.

4. The antenna of claim 3, wherein said impedance transformation device comprises metal strips or metal wires having a meandering configuration.

5. The antenna of claim 3, wherein said impedance transformation device is provided with tuning elements.

6. The antenna of claim 5, wherein said tuning elements comprise thickened areas of said impedance transformation device.

7. The antenna of claim 1, wherein said antenna comprises two radiators disposed equidistant from said conductor, and said radiators are vertically disposed from said ground surface.

8. The antenna of claim 1, further comprising a reflector.

9. The antenna of claim 8, wherein said reflector forms said ground surface.

10. The antenna of claim 8, wherein said radiators, said conductor, and said impedance transformation device are configured as an integral unit.

11. The antenna of claim 10, wherein said integral unit comprises a punched, bent piece of metal.

12. The antenna of claim 11, wherein said reflector is metallic and is positioned between a motor vehicle interior and said integral unit.

13. The antenna of claim 10, wherein said integral unit and said reflector are disposed in a common carrier part comprising non-conductive material.

14. The antenna of claim 13, wherein said reflector comprises a metal coating on said carrier part.

15. The antenna of claim 13, wherein said integral unit and said reflector are sealed in said carrier part.

16. The antenna of claim 15, wherein said carrier part has holding elements adapted for attaching said carrier to a corresponding motor vehicle part.

17. The antenna of claim 15, wherein said carrier part is attached to motor vehicle body parts prior to said body parts being installed on a motor vehicle being assembled.

18. The antenna of claim 13, wherein said carrier part is configured to correspond to a motor vehicle part.

19. The antenna of claim 13, wherein said integral unit, said reflector and said carrier part are operatively arranged in a three-dimensional manner which corresponds to a three-dimensional shape of an installation site for said antenna.

20. The antenna of claim 10, wherein said integrual unit and said reflector are disposed in a common carrier part, said common carrier part being securely cemented to a motor vehicle part.

21. The antenna of claim 8, wherein said reflector is electrically connected to a metallic motor vehicle body.

22. The antenna of claim 8, wherein a partial area of said reflector joins a flange of a motor vehicle roof.

23. The antenna of claim 1, wherein said antenna is disposed in a covered opening of a motor vehicle, said covered opening being permeable to electromagnetic radiation.

24. The antenna of claim 23, wherein said antenna is disposed entirely between a motor vehicle opening and an interior lining of molded parts of said vehicle.

25. The antenna of claim 24, further comprising a reflector configured to match said interior lining molded parts.

26. The antenna of claim 25, wherein said antenna is disposed in a vicinity of a roof edge of a front or rear window of said motor vehicle with said reflector electrically connected to a metallic roof surface of said motor vehicle.

27. The antenna of claim 1, wherein said ground surface has a recess for receiving a feed line for providing electrical connection to said conductor.

28. The antenna of claim 1, further comprising a feed line, said feed line being disposed along said ground surface and being electrically connected to said conductor.

29. The antenna of claim 1, further comprising a feed line comprising a coaxial cable having an inner conductor conductively connected to said conductor and an outer conductor conductively connected to said ground surface.

30. The antenna of claim 1, wherein said conductor tapers from said impedance transformation device to a terminal point on said ground surface.

31. The antenna of claim 1, further comprising a doubly laminated board having a first surface and a second surface, said first surface being coated with a metal coating thereby forming a reflector, and said second surface having a strip line coplanar line forming a feed line conductively connected to said conductor.

32. The antenna for claim 1, wherein said antenna is disposed in a motor vehicle and positioned symmetrical to a length-wise axis of said vehicle.

33. The antenna of claim 1, wherein said antenna is integrated into a plastic body part for a motor vehicle having plastic body parts.

34. The antenna of claim 1, further comprising a feed line, said feed line being disposed laterally along said ground surface and providing electrical connection to said feed conductor.

35. Antenna device comprising:

a ground surface;

an impedance transformation device, said impedance transformation device having an electrical length of about one-quarter wavelength of an average operating wavelength of said antenna device;

at least one vertical radiator vertically disposed between said ground surface and one end of said impedance transformation device; and a feed vertical conductor disposed between said ground surface and the other end of said impedance transformation device;

wherein said vertical radiator, said vertical conductor, and said impedance transformation device are configured as an integral unit comprising a punched, bent piece of metal.

36. The antenna device of claim 35, wherein said reflector is metallic and is positioned between a motor vehicle interior and said integral unit.

37. Antenna device comprising:

a ground surface;

an impedance transformation device, said impedance transformation device having an electrical length of about one-quarter wavelength of an average operating wavelength of said antenna device;

at least one vertical radiator vertically disposed between said ground surface and one end of said impedance transformation device;

a feed vertical conductor disposed between said ground surface and the other end of said impedance transformation device; and a doubly laminated board having a first surface and a second surface, said first surface being coated with a metal coating thereby forming a reflector, and said second surface having a strip line coplanar line forming a feed line conductively connected to said vertical conductor.

* * * * *